United States Patent [19]

Duplessy

[11] Patent Number: 4,739,884

[45] Date of Patent: Apr. 26, 1988

[54] PACKAGE INSERT FOR THE SEPARATION OF LAYERS OF ARTICLES

[76] Inventor: Herve Duplessy, La Prairie de Bouville, Le Val Saint-Germain, Saint-Cheron (Essonne), France

[21] Appl. No.: 930,548

[22] Filed: Nov. 12, 1986

[30] Foreign Application Priority Data

Nov. 12, 1985 [FR] France ..... 85 17262

[51] Int. Cl.[4] ..... B65D 21/02

[52] U.S. Cl. ..... 206/499; 53/472; 53/475; 206/430; 206/433; 206/489; 206/516; 206/522; 206/589; 206/593; 206/821; 217/19; 217/27; 220/23.6

[58] Field of Search ..... 206/386, 427, 433, 488, 206/489, 499, 515, 516, 522, 585, 589, 593, 821, 203, 430; 220/23.6; 428/137; 217/19, 27, 21; 53/244, 246, 475, 473, 474, 472, 398

[56] References Cited

U.S. PATENT DOCUMENTS

| | | | |
|---|---|---|---|
| 1,936,520 | 11/1933 | Neiman | 217/27 |
| 2,049,349 | 7/1936 | Blair | 217/27 |
| 2,134,908 | 11/1938 | Copeman | 217/27 X |
| 2,258,535 | 10/1941 | Buranelli | 206/489 X |
| 2,684,172 | 7/1954 | Ruppert | 206/821 X |
| 2,699,866 | 1/1955 | Russell, Jr. | 217/27 X |
| 3,131,829 | 5/1964 | Masser | 206/203 X |
| 3,199,708 | 8/1965 | Shlesinger, Jr. et al. | 217/19 |
| 3,217,875 | 11/1965 | Scheibel | 206/488 X |
| 3,229,814 | 1/1966 | Cowman | 206/585 |
| 3,351,264 | 11/1967 | Bostrom | 206/499 X |
| 3,485,355 | 12/1969 | Stewart | 206/427 X |
| 3,531,014 | 9/1970 | Lane | 206/203 |
| 3,592,350 | 7/1971 | Martelli et al. | 217/19 |
| 3,616,158 | 10/1971 | Rubens | 206/593 X |
| 3,949,876 | 4/1976 | Bridges et al. | 206/427 |
| 4,142,634 | 3/1979 | Leff et al. | 206/516 X |
| 4,235,065 | 11/1980 | Freeman | 206/522 X |
| 4,516,677 | 5/1985 | Rowland et al. | 206/499 X |

*Primary Examiner*—Stephen Marcus
*Assistant Examiner*—Bryon Gehman
*Attorney, Agent, or Firm*—Karl F. Ross; Herbert Dubno

[57] ABSTRACT

A package insert between two layers of articles comprises a rigid plate formed with openings spanned by at least one and preferably two flexible and advantageously elastic films which are deformed when upper articles are stacked on lower articles through the openings to nest the articles in place.

16 Claims, 4 Drawing Sheets

PACKAGE INSERT FOR THE SEPARATION OF LAYERS OF ARTICLES

FIELD OF THE INVENTION

My present invention relates to the packaging of fragile articles and, more particularly, to a package insert for the separation of superposed layers of articles in boxes, cases or the like. The invention also relates to the package using this insert and to a method of packaging employing the novel insert.

BACKGROUND OF THE INVENTION

It is known to provide package inserts between layers of articles which are designed not only to cushion the articles with respect to one another but also to wedge or retain the articles in place against shifting. Such inserts, in which the article can be partly nested, are utilized most frequently for fragile articles, e.g. glass bottles, which not only must be held against movement in the respective layers, but cannot be permitted to impact against one another from layer to layer in the stacking of the boxes constituting the packages or in handling if breakage is to be avoided.

Package inserts for these purposes have been provided heretofore as, for example, simple cardboard partitions with essentially the same internal contour as the receptacle or box in which packaging is to be effected. These separators can be relatively rigid to maintain an effective separation of the upper layer from the lower layer and, therefore, effective support of the upper layer of articles.

However, when the articles are of different shapes at their upper and lower ends as is the case with bottles, the cushioning effect is limited and there is always the risk of breakage when packages are stacked or roughly handled.

Furthermore, cardboard separators are very sensitive to moisture and in the case of long-term storage, especially at low temperatures, even where the package is provided in a fluid impermeable envelope or sheath, they are sensitive to moisture formed by condensation and may loose their integrity.

It is known to provide spacers between layers of articles in a package which are composed of thermoformed plastic materials which are molded with shapes corresponding to those of the articles to be seated therein.

These separators have been found to be highly effective in retaining the articles in place, i.e. preventing movement of the articles even if they have different shapes at their upper and lower ends and are also effective cushions between the layers of articles, so that stacking is permitted without danger of breakage, but they have the disadvantage that they cannot be used universally for a variety of different article configurations.

Furthermore, they may not always be biodegradable and thus environmentally sound packaging materials and, of course, are relatively costly because of the material used and the molding operating required, necessitating expensive molds for fabrication as well.

OBJECTS OF THE INVENTION

It is, therefore, the principal object of the present invention to provide an improved package insert which is of low cost, free from the drawbacks enumerated above, and has greater versatility than earlier package inserts.

Another object of the invention is to provide a package insert which affords good shock protection for the packaged articles, does not require molding or other expensive fabrication techniques or equipment, and is composed of materials which are of relatively low cost and a higher level of biodegradability than some of the package inserts utilized heretofore.

Still another object of this invention is to provide an improved package with a high degree of shock resistance, especially for elongated objects having different configurations at either upper and lower ends, e.g. bottles.

It is also an object of the invention to provide an improved method of making such a package.

SUMMARY OF THE INVENTION

These objects and others which will become apparent hereinafter are attained, in accordance with the invention in a package insert for the separation of layers of articles which comprises a plate of a rigid material formed with openings whose contours correspond to those of the projections of the articles on a horizontal plane, and at least one film of a relatively flexible, supple and deformable material fixed on and advantageously covering at least one face of the plate and covering at least all of the openings of the plate of rigid material.

In packaging the articles, therefore, when the insert is placed over a lower layer with the articles thereof aligned with the openings and the upper layer of articles are then placed on top of the insert, the film deforms, being stretched between the upper and lower articles in each opening, without breaking, thereby nesting the upper and lower articles in the recesses or nests formed by the deformed film in each opening, holding the articles apart and assuring both a "wedging" of the articles against movement without the respective layers and bracing the articles of the upper and lower layers relative to one another through the stretched synthetic resin film or foil to maintain a separation between the upper and lower articles by the area each layer of the film or foil interposed between them in spite of the different configurations of the lower end of the upper article and upper end of the lower article.

The rigid plate ensures a certain rigidity of the package insert and allows it to be placed manually or automatically on the layer of articles to be protected.

The insert has a high degree of versatility because, for a given size of the openings of the insert, various types and sizes of articles which may be different in configuration but have a similar projection in a horizontal plane, can be packaged. For one and the same insert, therefore, a variety of articles of different form can be packaged because each type of article can deform the film in the respective opening as may be required for the nesting purpose. This, of course, is not possible using thermoformed plastic inserts as have been provided heretofore.

According to a feature of the invention, the rigid plate can be covered by two foils or films of elastic material bonded to opposite faces of the plate and thus providing two film layers spanning each opening.

When the films are composed of plastic material, they may be thermally bonded or glued particularly simply to the central plate and the double thickness in each opening can reinforce the protective effect between the articles while the two films also protect the central plate against moisture, especially when it is composed of a cardboard.

According to a feature of the invention, one or more air cushions can be formed between the two films by thermally bonding them together within the openings, thereby increasing the protection against shock transmission.

According to yet another feature of the invention, a respective disk of rigid material can be disposed substantially at the center of each of the openings between the two films spanning same and, if desired, a plurality of connecting webs can affix each of these disks to the edge bounding the respective opening. The disks and webs can be formed integrally with the plate during the formation of the openings therein and the disks are readily rupturable upon the stacking of each upper article on a lower article after positioning of the insert on a layer of lower articles.

The disks can have shapes conforming substantially to that of the upper end of the lower articles. The plate can be formed of cardboard, paper, metal, wood or plastic and the film is preferably a polyethylene or polypropylene film.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
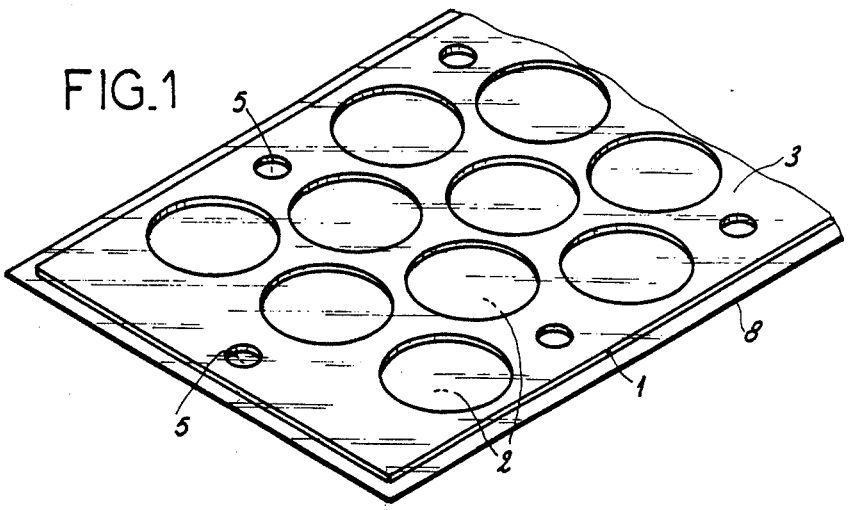
FIG. 1 is a perspective view of a portion of a package insert according to one embodiment of the invention.
Figure 2:
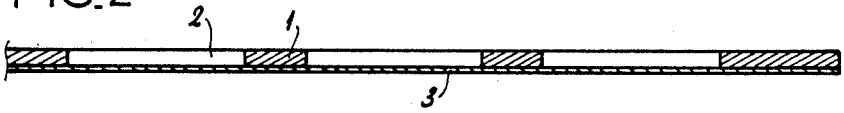
FIG. 2 is a partial transverse section through the insert of FIG. 1 in the case in which the insert has only a single elastic film.

A package insert, as can be seen from FIG. 1, according to the invention, comprises a rigid plate 1 provided with openings 2 and covered at least in the region of the openings by at least one film 3 of a deformable material. As can be seen from FIG. 2, the film 3 spans openings and, of course, can be deformed upwardly therein by articles disposed on a lower layer of these articles in a package.

Figure 11:
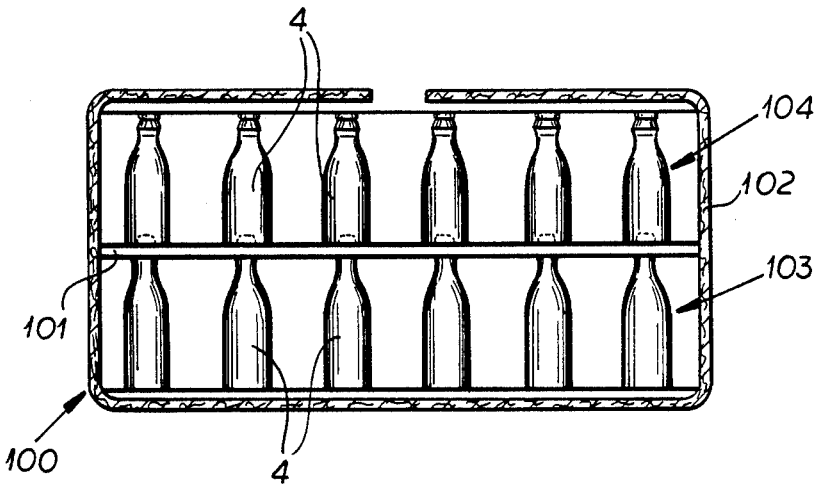
FIG. 11 is a sectional view through a package provided with an insert according to the present invention.

In this regard, reference may be had to FIG. 11 in which the package is represented at 100, the insert at 101, the carton or box receiving the articles at 102, and the layers of articles at 103 and 104, respectively. The articles are here shown to be glass bottles 4 whose upper ends, of course, can have narrow mouths and thus differ in size from the lower ends which can have downwardly open recesses so that each upper end of a bottle nests in a lower end of the overlying bottle through the intermediary of the film or films.

Figure 3:
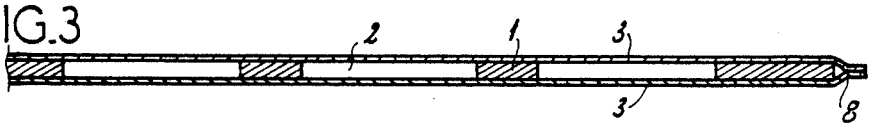
FIG. 3 is a view similar to FIG. 2 of an embodiment in which the insert has two elastic film layers.
Figure 4:
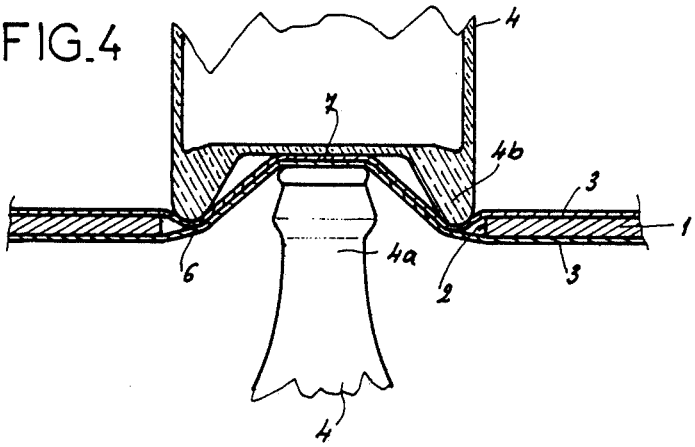
FIG. 4 is a vertical section through a portion of a package illustrating the deformation of a double film in one of the openings of the package insert of FIG. 3.

In the embodiment of FIGS. 3 and 4, two films 3 cover the opposite faces of the plate 1. The films 3 can be connected to the rigid plate by any conventional method such as gluing, thermal welding and the like.

As can be seen from FIG. 4, the openings 2 have dimensions corresponding to those of the contour of the article 4 to be packaged and more specifically to the contour of its projection in a horizontal plane of the articles.

For example, in the embodiment of FIG. 4 where the articles are bottles 4 which have a recessed bottom **4*b* of cylindrical configuration, the projection in a horizontal plane, i.e. the horizontal projection, is a circular configuration with a diameter corresponding to the cylindrical lower part 4*b* of the bottle. Consequently the openings 2 have a circular form whose diameter corresponds to the diameter of the lower part 4*b* of the bottle or this projection. As is also clearly visible from FIG. 4, the films spanning the opening 2** are deformed between the upper end of each bottle and the lower end thereof so that a nest is provided for both the upper and lower ends of the bottles which deform this film, thereby retaining the bottles against lateral movement when each of the bottles of the upper layer is positioned above a corresponding bottle of the lower layer.

The upper end or mouth **4*a* of the bottles of the lower layer penetrate through the opening in the insert and into the recess at the bottom 4*b* of the bottle located thereabove, this penetration being permitted by the deformation of the film or films 3 spanning the opening. The deformation may be an elastic or a non-elastic deformation and stretches the film between the bottom edge 6 of the upper bottle, forming the points of contact or support of the upper bottle on the insert. The films rest upon the mouth 4*a* of the lower bottle over the region 7** corresponding to the zone of contact with the lower bottle.

Not only are the two bottles thus nested and "wedged" in place, but the upper bottle is centered relative to the lower bottle automatically while a separation is maintained between two superposed bottles via the film. The stretched film connects the two bottles together while preventing direct contact so that the bottles are cushioned with respect to one another as is particularly important with fragile, e.g. glass bottles.

Naturally, the contact points 6 and 7 between the film layers and the upper and lower bottles will vary depending upon the shape of the bottles.

The fact that the plate 1 is composed of a rigid material allows it to be inserted into the box 102 manually or automatically where it is positioned upon the lower layer 103 of the bottles 4.

The openings 2 can accommodate bottles 4 of different shapes as long as their horizontal projections correspond to the contours of this opening so that the bottles will be able to deform the film as described to provide the requisite degree of protection of the superposed bottle.

It will thus be apparent that the package insert of the invention can be used for different types of objects and can thus be more or less standardized.

The material from which the rigid plate 1 is constructed is not important except that it should have a certain rigidity. Suitable materials include wood, thick paper, cardboard, or plastic or even metal, although an ABS plastic may be preferable in many cases.

The films are preferably composed of polyethylene or polypropylene and either bonded together through the openings or bonded to the faces of the plate directly, or both.

Where two film layers are provided, holes can be formed regularly around the perimeter of the plate 1 through which the two layers can be thermally bonded to hold them on the plate.

Furthermore, the film can be bonded around the perimeter of the plate in a heat seal as shown at 8 in FIGS. 1 and 3.

The insert can thus be fabricated at a much lower cost than thermoformed plastics. It can thus be disposable although it is also reusable even if the plate is of a low cost material such as cardboard. Reuse is preferred when the plate is composed of an ABS plastic and indeed the plate can be recovered with elastic films for reuse if desired.

The two plastic films also protect the rigid plate against attack by moisture or other corrosive substances which might tend to destroy or diminish the mechanical characteristics of the rigid plate.

This is particularly of importance where the rigid plate 1 is formed from cardboard and permits storage in the outdoors without deterioration of the cardboard plate.

Figure 5:
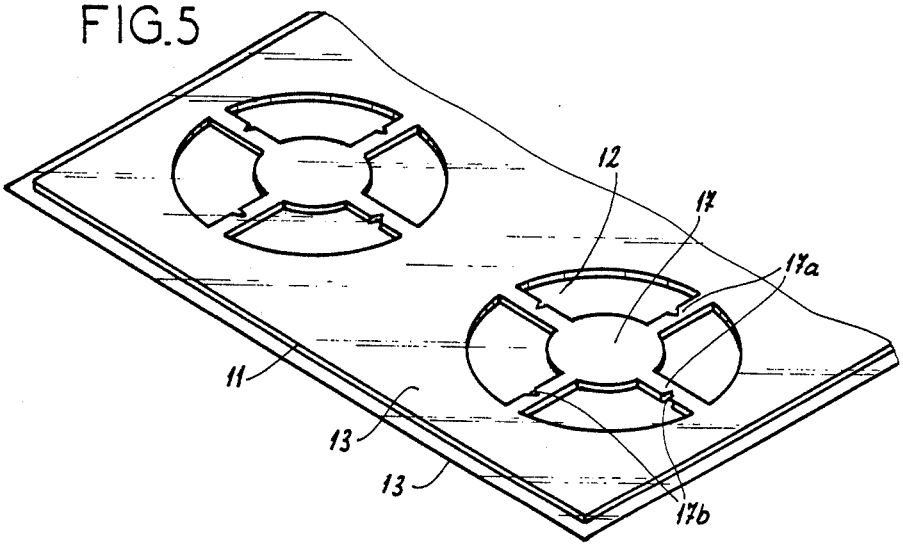
FIG. 5 is a perspective view of a package insert according to a third embodiment of the invention.
Figure 6:
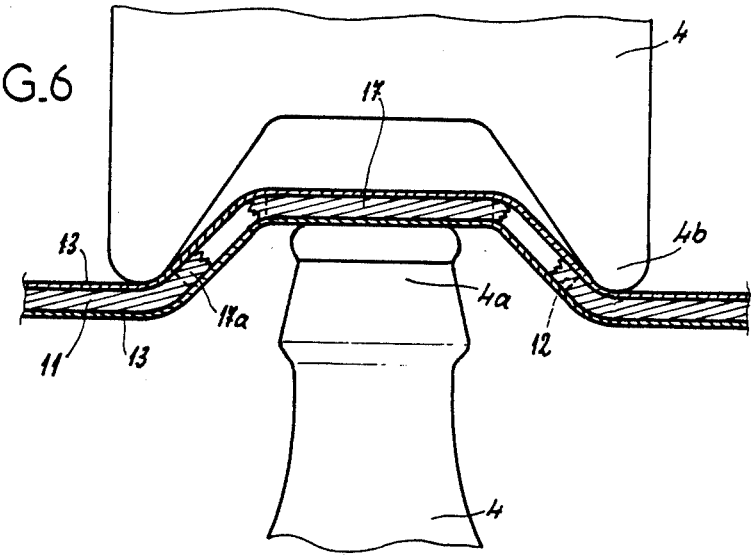
FIG. 6 is a partial section illustrating the use of the insert of FIG. 5.

FIGS. 5 and 6 show a second embodiment of the package insert according to the invention in which the same or similar reference numerals, increased by 10, are used to identify elements which have been described in connection with FIGS. 1–4.

Here the rigid plate 11 is covered by two elastic film layers 13 and provided with openings 12 whose contours correspond to the horizontal projections of the articles 4 to be packaged.

In this embodiment, however, disks 17 of the same material as the rigid plate 11 are provided at the center of each opening 12 between the film layers and are connected by webs **17*a* which are formed with breakaway notches 17*b* to facilitate rupture of these webs. The webs 17*a*, the notches 17*b*, the openings 12 and the remainder of the plate 11** may be formed by die-cutting at the time that the plate is fabricated.

In the embodiment of FIG. 5, four such webs connect each disk to the edge of the opening 12 although any other number may be used in excess of two.

Each disk 17 has its dimension correspond to the contour of the upper end **4*a* of the article 4** to be packaged.

Thus in the case of FIG. 5, the disk 17 has a diameter corresponding to that of the mouth **4*a* of the bottle 4**.

When the upper bottle is placed on the lower bottle with the insert interposed therebetween, the webs **17*a* rupture and permit the deformation of the two elastic film layers 13 for interpenetration of the two bottles. A rigid part 17** is thus formed in the zone of contact with the lower bottle, thereby increasing the cushioning effect between the two bottles.

The opening 12 in the embodiment of FIG. 6 has a contour which is slightly less than the horizontal projection of the upper bottle 4 so that the region of contact 16 of the upper bottle is against the rigid plate around the opening 12 although the film is nevertheless deformed between this zone of contact and the top of the underlying bottle.

FIGS. 7–10 show other embodiments of the invention utilizing the same reference numerals as in FIGS. 1–4, increased respectively by 20, 30, 40 and 50.

Figure 7:
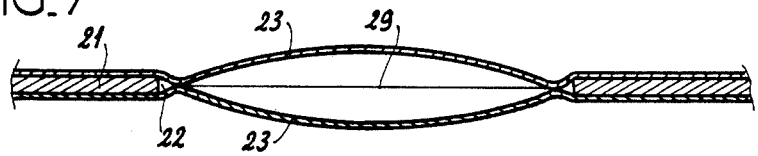
FIGS. 7–10 are sectional views similar to FIG. 3 containing other embodiments of a package insert according to the invention.

In the embodiment of FIG. 7, the rigid plate 21 is covered by two films 23 of deformable material and provided with openings 22 spanned by these films. The films 23 are thermally welded together at 23' within these openings and are inflated with air to form an air cushion 29. The air is injected simultaneously with formation of the seal. The air cushions 29 thus increase the shock damping between the upper and lower articles.

Figure 8:
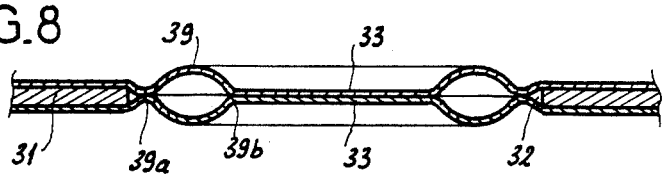
Figure 9:
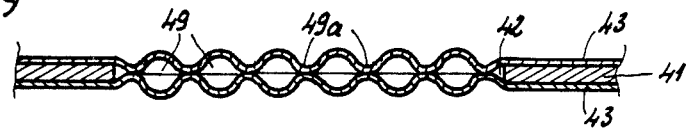
Figure 10:
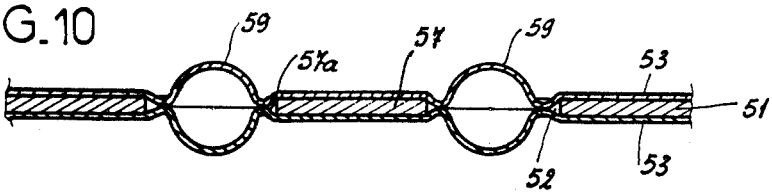

Other configurations of the air cushions are shown at 39, 49 and 59 at FIGS. 8–10 in the respective openings 32, 42, 52.

In the case of FIG. 8, the cushion 39 has an annular configuration formed by two circular thermal welds **39*a* and 39*b* formed along the perimeter of the opening 32** and a certain distance inwardly thereof.

In the case of FIG. 9, multiple air cushions 49 are formed by welds **49*a*** formed along small circles.

The air cushions 29, 39, 49 can have other configurations and are deformed during packaging of the articles in the manner previously described. They, however, provide an additional protection against shock, especially for the packaging of fragile objects composed, for example, of glass. The several embodiments described can be combined as has been illustrated, for example in FIG. 10 in which a disk 57 of rigid material and air cushions 59 in the form of arcs of a circle are provided simultaneously within each opening 52, the cushions 59 extending each between two webs **57*a*, the plate 51 being provided with the films 53**.

I claim:

1. A package insert for the separation of layers of articles, comprising:

a plate of a rigid material formed with openings whose contours correspond substantially to the projections of said articles onto a horizontal plane;

two films of flexible deformable material fixed to said plate, covering opposite faces of said plate and spanned over said openings and deformable between articles of said layers through said openings;

a respective disk of rigid material disposed substantially at the center of each of said openings and received between the two films spanning the respective opening; and a plurality of connecting webs affixing each of said disks to the edge bounding the respective opening, said webs formed integrally with said plate and the respective disk and with rupture facilitating means for inducing rupture upon application of an upper article on a layer article after positioning of said insert on a layer of lower articles.

2. The package insert defined in claim 1 wherein said disks have shapes conforming substantially to that of the upper ends of the lower articles.

3. The package insert defined in claim 1 wherein said films are sealed together in each of said openings to trap between them at least one respective gas cushion in each of said openings.

4. The package insert defined in claim 3 wherein to form said cushions gas is injected between said films simultaneously with the sealing of the films together in each of said openings.

5. The package insert defined in claim 4 wherein said cushions are formed by a respective air bubble in each of said openings.

6. The package insert defined in claim 4 wherein said cushions are formed at least in part with an annular configuration.

7. The package insert defined in claim 4 wherein said plate is composed of a material selected from the group which consists of cardboard, paper, metal, wood and plastic, and said film is composed of a material selected from the group which consists of polyethylene and polypropylene film.

8. A package comprising:

a box;

a layer of upstanding articles in said box;

a package insert in said box overlying said layer of articles and adapted to retain said articles in place; and a layer of upstanding articles seated on said insert, said package insert comprising:

a plate of a rigid material formed with openings whose contours correspond substantially to the projections of said articles onto a horizontal plane, a package insert in said box overlying said layer of articles and adapted to retain said articles in place; and a layer of upstanding articles seated on said insert, said package insert comprising:

a plate of a rigid material formed with openings whose contours correspond substantially to the projections of said articles onto a horizontal plane, two films of flexible deformable material fixed to said plate, covering opposite faces of said plate and spanned over said openings and deformable between said articles of said layers through said openings, a respective disk of rigid material disposed substantially at the center of each of said openings and received between the two films spanning the respective opening, and a plurality of connecting webs affixing each of said disks to the edge bounding the respective opening, said webs being formed integrally with said plate and the respective disk and with rupture facilitating means for inducing rupture upon application of an upper article on a lower article after positioning of said insert on a layer of lower articles.

9. The package defined in claim 8 wherein said disks have shapes conforming substantially to that of the upper ends of the lower articles.

10. The package insert defined in claim 9 wherein said cushions are formed at least in part with an annular configuration.

11. The package defined in claim 8 wherein said films are sealed together in each of said openings to trap between them at least one respective gas cushion in each of said openings.

12. The package defined in claim 8 wherein to form said cushions gas is injected between said films simultaneously with the sealing of the films together in each of said openings.

13. The package defined in claim 12 wherein said cushions are formed by a respective air bubble in each of said openings.

14. The package insert defined in claim 8 wherein said plate is composed of a material selected from the group which consists of cardboard, paper, metal, wood and plastic, and said film is composed of a material selected from the group which consists of polyethylene and polypropylene film.

15. A method of packaging articles, comprising the steps of:

disposing a lower layer of said articles in a box;

applying to the top of said layer a package insert comprising a plate of a rigid material formed with openings whose contours correspond substantially to the projections of said articles onto a horizontal plane, two films of a flexible deformable material fixed to said plate, covering opposite faces of said plate and spanned over said openings and deformable between said articles of said layers through said openings;

a respective disk of rigid material disposed substantially at the center of each of said openings and received between the two films spanning the respective opening, and a plurality of connecting webs affixing each of said disks to the edge bounding the respective opening, said webs formed integrally with said plate, and having rupture facilitating means for inducing rupture; and applying to said package insert an upper layer of said articles, thereby deforming said film through said openings with the articles of said upper layer against the articles of said lower layer to retain the articles of both layers in place and rupturing said connecting webs upon application of an upper article on a lower article.

16. The method defined in claim 15 wherein said articles are bottles, further comprising cushioning said bottles of said upper and lower layers by providing an air cushion between two suck films in each opening.

* * * * *